US005961022A

United States Patent [19]

Pfeiffer et al.

[11] Patent Number: 5,961,022

[45] **Date of Patent: *Oct. 5, 1999**

[54] STRIP PINCH APPARATUS

[75] Inventors: Joachim Pfeiffer; Peter Sudau, both of Hilchenbach, Germany

[73] Assignee: SMS Schloemann-Siemag Aktiengesellschaft, Düsseldorf, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/657,896

[22] Filed: Jun. 7, 1996

[30] Foreign Application Priority Data

Jun. 9, 1995 [DE] Germany ..... 195 20 709

[51] Int. Cl.[6] ..... B65H 20/00

[52] U.S. Cl. ..... 226/176; 226/187

[58] Field of Search ..... 226/186, 187, 226/183, 176, 177

[56] References Cited

U.S. PATENT DOCUMENTS

| | | | |
|---|---|---|---|
| 3,589,582 | 6/1971 | Fujimoto | 226/187 X |
| 3,661,310 | 5/1972 | Gross | 226/177 X |
| 4,119,256 | 10/1978 | Vogtmann et al. | 226/187 X |
| 5,000,439 | 3/1991 | Yoshizaw | 226/187 X |
| 5,072,872 | 12/1991 | Casset et al. | 226/176 |

FOREIGN PATENT DOCUMENTS

| | | | |
|---|---|---|---|
| 5-92853 | 4/1993 | Japan | 226/177 |

*Primary Examiner*—Michael R. Mansen
*Attorney, Agent, or Firm*—Friedrich Kueffner

[57] ABSTRACT

A driver for rolled strip includes a first roll which is mounted so as to be essentially stationary and a second roll which is adjustable relative to the first roll. The second roll is supported in a swivel frame which is adjustable by a pressure medium cylinder. The swivel frame is composed of two oppositely located links which are connected in the area of their common swivelling axis by a base which is supported on both sides thereof in the driver frame. The links can be adjusted by pressure medium cylinders which can be actuated separately and the base connecting the links is constructed as a torsion spring.

4 Claims, 3 Drawing Sheets

STRIP PINCH APPARATUS

BACKGROUND OF THE INVENTION

1. Field of the Invention

The present invention relates to a driver for rolled strip including a first roll which is mounted so as to be essentially stationary and a second roll which is adjustable relative to the first roll. The second roll is supported in a swivel frame which is adjustable by means of a pressure medium cylinder. The swivel frame is composed of two oppositely located links which are connected in the area of their common swivelling axis by a base which is supported on both sides thereof in the driver frame.

2. Description of the Related Art

Drivers of the above-described type have a base which rigidly connects the links to one another. In order to be able to influence the characteristic curve of the tensile force exerted by driving, the rolls have been mounted in chocks which are constructed so as to be adjustable by applying a force. Adjustably constructed stops have also already been provided for limiting the movement of the links. However, the adjusting units required for this purpose are very cumbersome because they are subjected to high bearing forces and the adjusting devices which may be desired for the bearing forces have to be constructed accordingly. The complicated construction and the necessary rigid configuration do not permit an automatic regulation which is frequently desired.

SUMMARY OF THE INVENTION

Therefore, it is the primary object of the present invention to further develop the construction of a driver of the above-described type and the adjusting drives therefor in such a way that the adjusting procedures and/or regulating procedures can be carried out with simple means.

In accordance with the present invention, the links can be adjusted by pressure medium cylinders which can be actuated separately and the base connecting the links is constructed as a torsion spring.

The introduction of different adjusting forces together with the fact that the base is torsionally constructed makes it possible to effect different swivel angles of the links by applying relatively small differential forces of the adjusting means, without impairing the stable support of the roll which is capable of swivelling.

In addition, the torsional connection ensures that, even when the driver is controlled incorrectly, the resulting incorrect adjustment of the adjustable roll remains within tolerable limits.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENT

Figure 1:
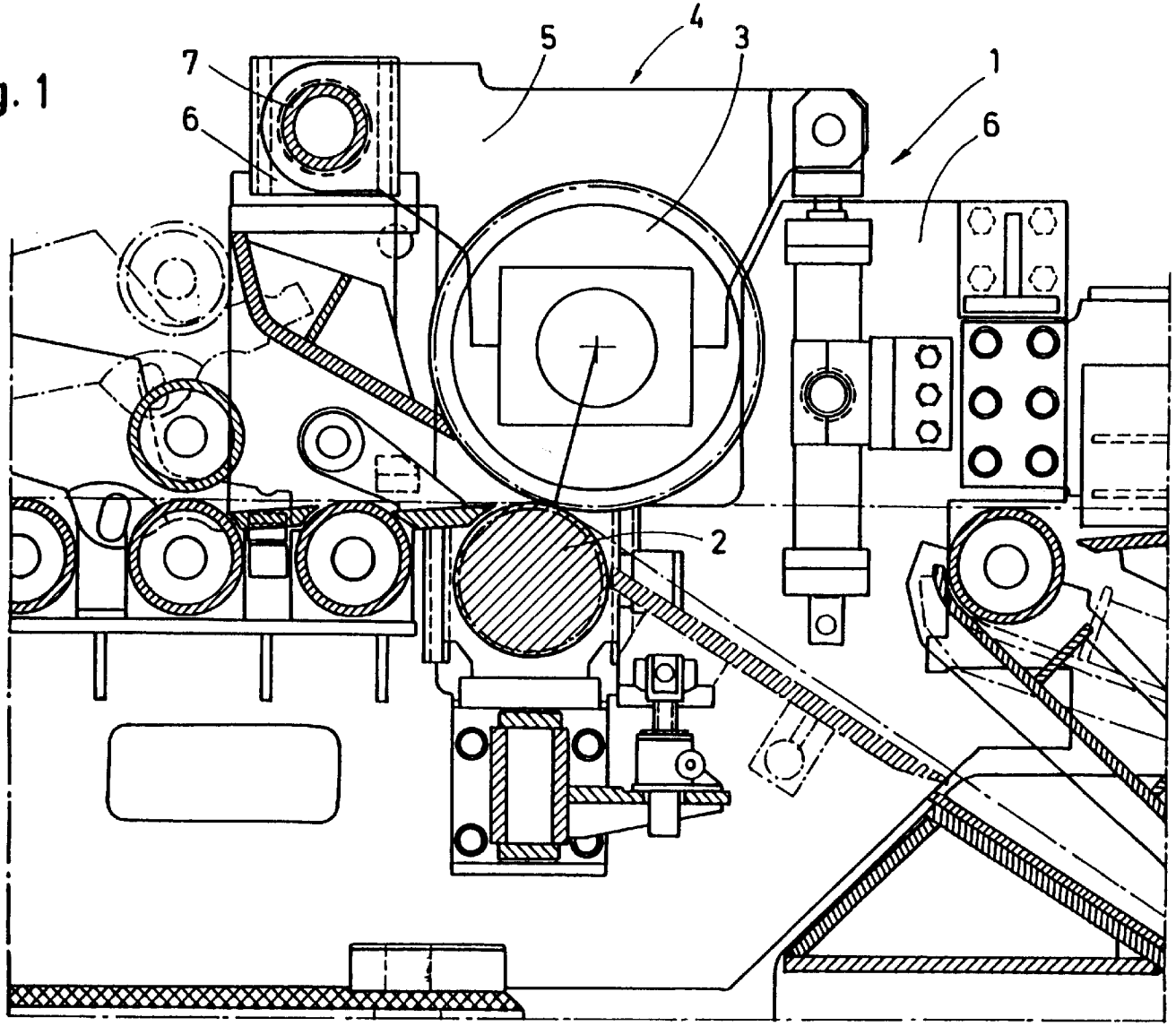
FIG. 1 is a partially sectional view of a driver according to the present invention.

FIG. 1 of the drawing shows a driver 1 including a roll 2 which is mounted so as to be essentially stationary and a roll 3 which is adjustable relative to roll 2. The roll 3 is mounted in a swivel frame 4 which is composed of two oppositely located links 5, 5' which have a common swivelling axis 7 in the frame 6 of the driver 1. Pressure medium cylinders 8 are arranged at the ends of the links 5, 5' located opposite the swivelling axis 7. The pressure medium cylinders 8 are mounted in the frame 6 so as to be capable of swivelling.

Figure 2:
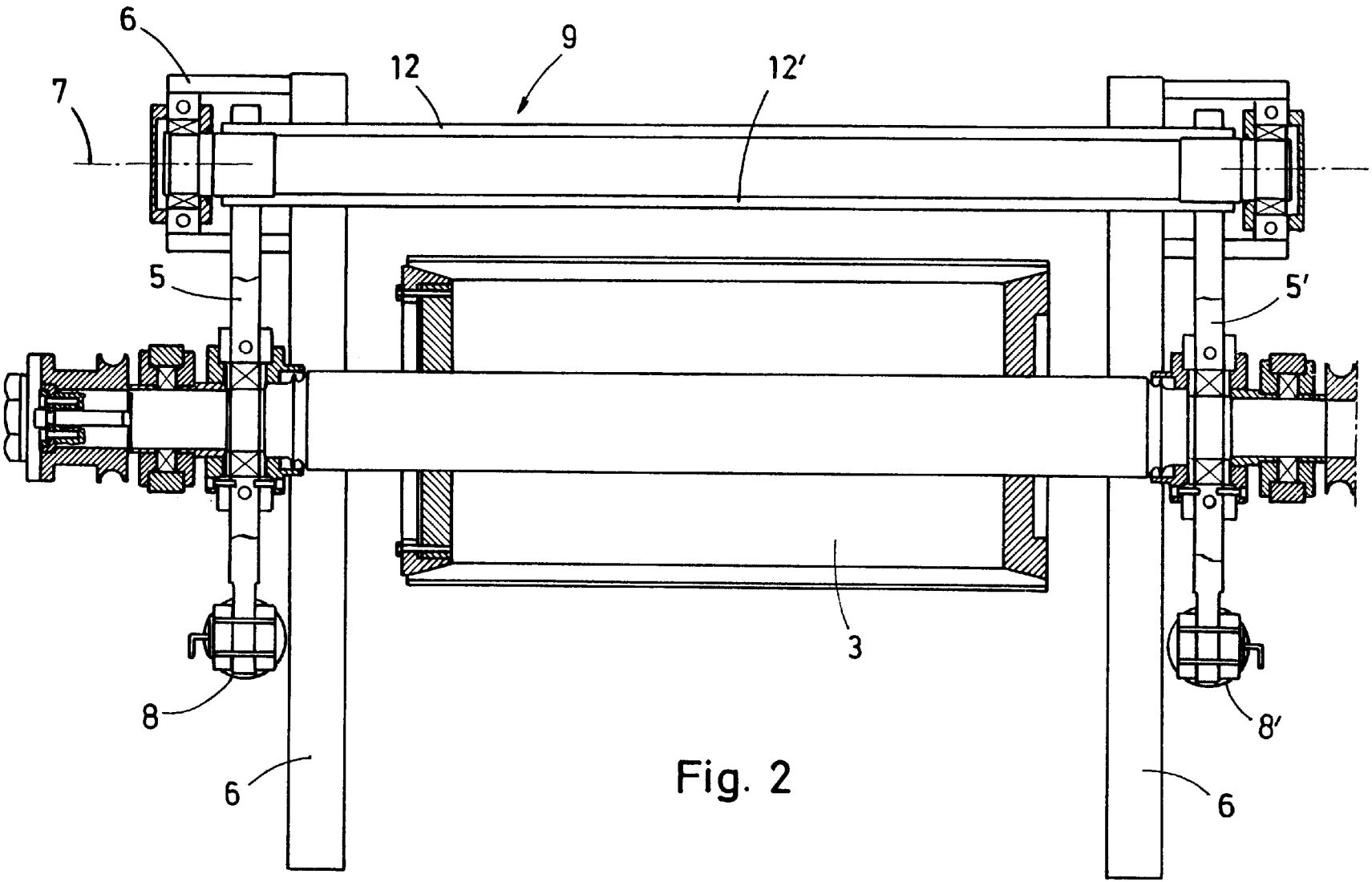
FIG. 2 is an elevational view, also partially in section, of the swivel frame of the driver according to the present invention including the second roll.
Figure 2A:
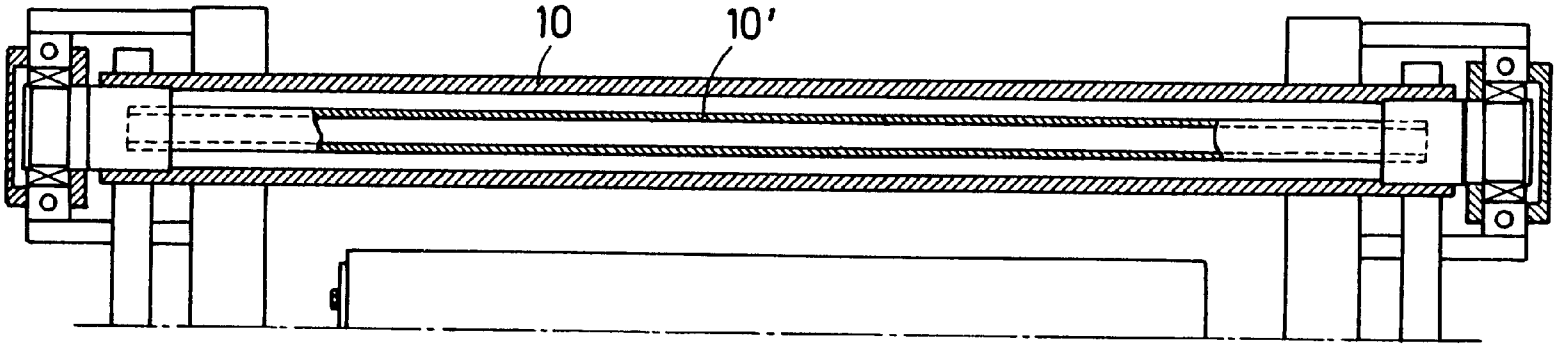
FIGS. 2*a* and 2*b* are partially sectional views of the base of the drive.
Figure 2B:
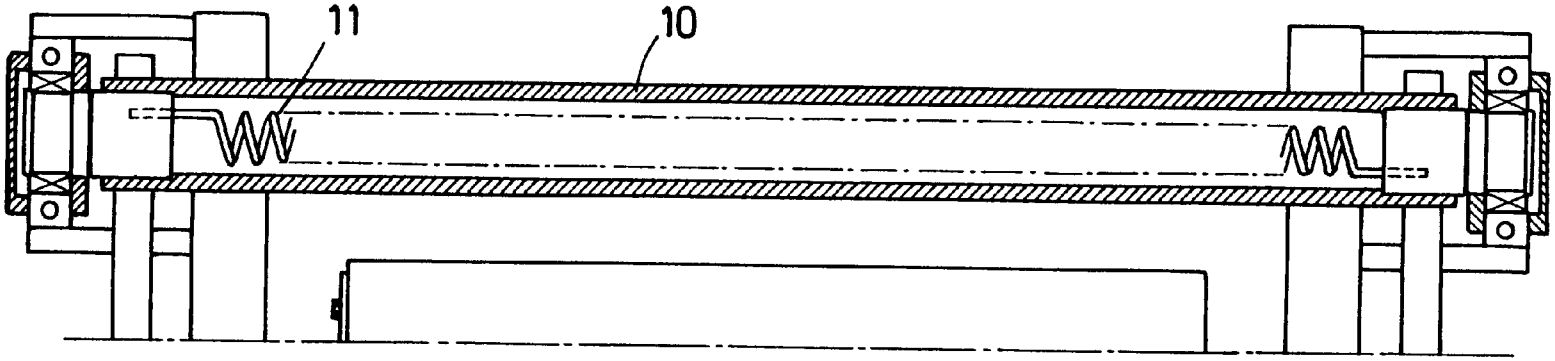

FIG. 2 of the drawing shows that the links 5, 5' are mounted in the frame 6 so as to be capable of swivelling about the swivelling axis 7. In the area of the swivelling axis 7, the links 5, 5' have a common base 9 which connects the links 5, 5' to one another. The base 9 is composed of a torsion tube 10 and includes a torsion spring 11, as shown in FIG. 2*b*. The base 9 may also be composed of a plurality of concentrically arranged torsion tubes 10, 10', as shown in FIG. 2*a*. On the other hand, the base may be composed of one or more torsion rods 12, 12' as shown in FIG. 2. The roll 3 is rotatably mounted in the links 5, 5'. Pressure medium cylinders 8, 8' act on the free ends of the links 5, 5'.

The torsion tube 10 makes it possible that, when different forces are applied, the links 5, 5' are also swivelled to a different extent by the pressure medium cylinders 8, 8'. However, the torsion tube 10 also ensures that the difference in the swivel range of the links 5, 5' does not exceed a predetermined dimension which depends essentially on the stiffness of the torsion tube. By introducing different adjusting forces with a relatively small differential force of the pressure medium cylinders 8, 8', it is possible to achieve different swivelling angles of the links 5, 5' and, thus, of the roll 3. This makes it easily possible to influence the tensile force exerted by the driver onto the strip by a simple swivelling of the roll 3, so that an optimum distribution of tensile forces can be achieved without difficulty.

While specific embodiments of the invention have been shown and described in detail to illustrate the inventive principles, it will be understood that the invention may be embodied otherwise without departing from such principles.

We claim:

1. A driver for rolled strip, the driver comprising a driver frame, a swivel frame composed of two oppositely located links mounted in the driver frame, the links having a common swivel axis, a torsionally constructed base having two sides, the base being supported on both sides thereof in the driver frame, the base connecting the links in an area of the common swivel axis, a first roll mounted so as to be essentially stationary in the driver frame, and a second roll mounted in the swivel frame so as to be adjustable relative to the first roll, further comprising two pressure medium cylinders, wherein each pressure medium cylinder is connected to one of the links for separately adjusting the links, wherein the base comprises a torsion spring.

2. A driver for rolled strip, the driver comprising a driver frame, a swivel frame composed of two oppositely located links mounted in the driver frame, the links having a common swivel axis, a torsionally constructed base having two sides, the base being supported on both sides thereof in the driver frame, the base connecting the links in an area of the common swivel axis, a first roll mounted so as to be essentially stationary in the driver frame, and a second roll mounted in the swivel frame so as to be adjustable relative to the first roll, further comprising two pressure medium cylinders, wherein each pressure medium cylinder is connected to one of the links for separately adjusting the links, wherein the base is comprised of at least one torsion tube.

3. The driver according to claim 2, wherein the base is comprised of a plurality of concentrically arranged torsion tubes.

4. A driver for rolled strip, the driver comprising a driver frame, a swivel frame composed of two oppositely located links mounted in the driver frame, the links having a common swivel axis, a torsionally constructed base having two sides, the base being supported on both sides thereof in the driver frame, the base connecting the links in an area of the common swivel axis, a first roll mounted so as to be essentially stationary in the driver frame, and a second roll mounted in the swivel frame so as to be adjustable relative to the first roll, further comprising two pressure medium cylinders, wherein each pressure medium cylinder is connected to one of the links for separately adjusting the links, wherein the base is comprised of at least one torsion rod.

* * * * *